United States Patent [19]

Klöber

[11] Patent Number: 4,803,816

[45] Date of Patent: Feb. 14, 1989

[54] ROOFING SLAB

[75] Inventor: Johannes Klöber, Ennepetal, Fed. Rep. of Germany

[73] Assignee: Hans Klöber KG, Ennepetal, Fed. Rep. of Germany

[21] Appl. No.: 93,805

[22] Filed: Sep. 4, 1987

[30] Foreign Application Priority Data

Oct. 9, 1986 [DE] Fed. Rep. of Germany ..... 8626769

[51] Int. Cl.[4] ..... E04D 13/14

[52] U.S. Cl. ..... 52/219; 98/60; 98/66.1

[58] Field of Search ..... 52/219, 218; 98/60, 98/61.1, 66.1

[56] References Cited

U.S. PATENT DOCUMENTS

| | | | |
|---|---|---|---|
| 363,236 | 5/1887 | Hodel | 98/60 |
| 1,085,889 | 2/1914 | Carl | 52/219 |
| 2,274,403 | 2/1942 | Filkins | 98/60 |
| 3,160,087 | 12/1964 | Davidson | 52/219 |
| 3,874,138 | 4/1975 | Storch | 52/219 |

FOREIGN PATENT DOCUMENTS

| | | | |
|---|---|---|---|
| 2523381 | 12/1976 | Fed. Rep. of Germany | 52/199 |
| 2559412 | 2/1977 | Fed. Rep. of Germany | 52/219 |
| 2530709 | 1/1984 | France | 52/218 |

*Primary Examiner*—Henry E. Raduazo
*Attorney, Agent, or Firm*—Martin A. Farber

[57] ABSTRACT

A roofing slab with vent opening which is arranged in a central region thereof and is limited by a peripheral edge collar and over which a cover extends in hood-like manner. A hose connection pipe directed towards a bottom side of the roofing slab is coordinated with the opening. The edge collar projects beyond the bottom side of the roofing slab and extends into a dish, and the hose connecting pipe projects on the bottom of the dish.

7 Claims, 3 Drawing Sheets

M
5'
1
10

4
5
12
13
9
10
13
Sch

V
VI
X
1
9
10
Sch

Sch
12
5'
4
10
9

ROOFING SLAB

FIELD AND BACKGROUND OF THE INVENTION

The present invention relates to a roofing slab having a vent opening which is arranged in the central region, is limited by a peripheral edge collar and is extended over in hood-like manner by a cover and with which there is associated a hose connecting pipe directed towards the bottom side of the roofing slab.

A roofing slab of this type is known from Federal Republic of Germany OS No. 26 59 788. The collar over which the cover extends is edge-locked in the vent opening cut out of the roofing slab which is formed by a tile, detent projections engaging below the bottom of the edge of the opening. The hose connecting pipe which is introduced from the bottom is associated in the same manner except that it grips over the top edge of the vent opening by corresponding detent means. This development is still too difficult in manufacture for an article of mass consumption. The detent evasion movement extends into the support walls. One is thereby limited to certain materials and in any event to ones which return completely into their position.

SUMMARY OF THE INVENTION

The object of the invention is to develop a roofing slab of this type in a manner which is more favorable from the standpoint of manufacture as well as of the mounting thereof.

This object is achieved by the invention by the edge collar (K) projecting also beyond the bottom side (U) of the roofing slab and passing into a dish (Sch) on the bottom (9) of which the hose connecting pipe (10) projects.

As a result of this development, there is obtained a roofing slab of the introductory-mentioned type which is of increased value in use. The edge collar is continued beyond the bottom side of the roofing slab and passes there into a dish on the bottom of which the hose connecting pipe protrudes. This can be produced as a single part by molding. As a result of the difference in levels of the roofing slab and the dish which is obtained thereby, a high degree of stability is furthermore obtained. In this way also a rather slight wall thickness can be used. The conventional fastening means can be dispensed with in such a formation. If preference is given to a version, which would have the advantage of an inspection of the dish, for example so as to remove leaves or similar particles which have been blown into it, an advantageous embodiment is then obtained in the manner that the edge collar is the mounting for the dish, which is developed as a separate structural part. Here it is favorable from a standpoint of assembly that the side wall of the dish overlap the edge collar and that the attachment be effected by screws which pass through both. The region of overlap leads to an additional mutual stabilizing of the individual parts which are connected to each other. It is merely necessary to loosen the screws in order to clean the dish. Another advantageous feature is that the bottom of the dish is deepened in funnel shape towards the hose connecting pipe. Here a flat conical shape can be basically used; however, a flat pyramidal shape has proven particularly favorable from the standpoint of stabilization. It is furthermore favorable for assembly for the hose connecting pipe to be arranged off center with respect to the rectangular bottom and be tangent to the middle thereof. In this way, water of condensation can always flow off immediately and no block of ice is formed in winter. Finally, a feature of the invention is that the edge collar crosses and closes off the inner hollow resulting from the transverse arching of the roofing slab; the edge, i.e. the individual sections of the collar, extends in a common plane.

BRIEF DESCRIPTION OF THE DRAWINGS

The invention is explained in further detail below with reference to an illustrative embodiment which is shown in the drawings, in which.

DETAILED DESCRIPTION OF THE PREFERRED EMBODIMENTS

Figures 1, 2, 3, 4:
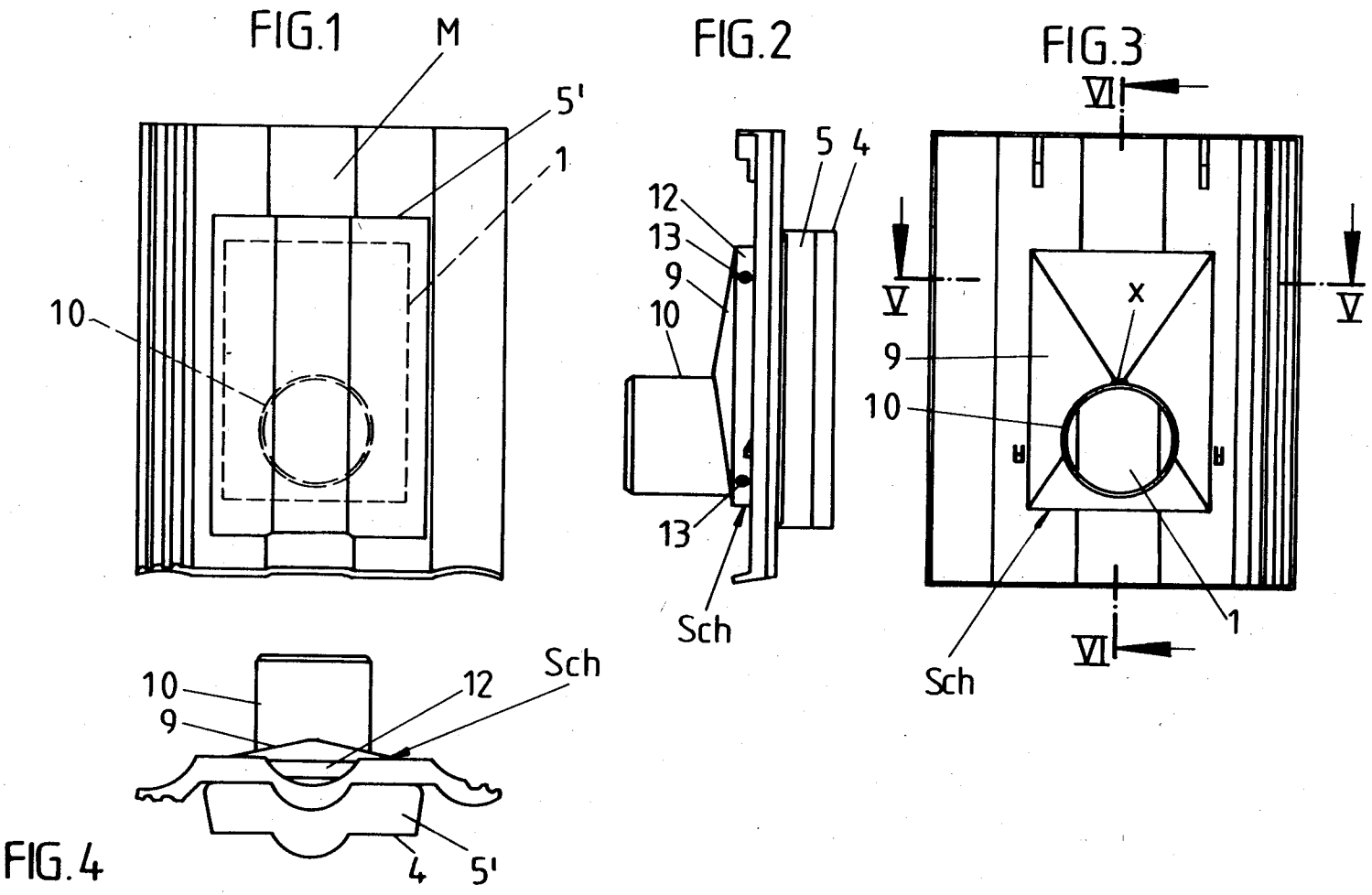
FIG. 1 is a top view of the roofing slab developed in accordance with the invention.
FIG. 2 is a side view thereof.
FIG. 3 is a bottom view of the roofing slab.
FIG. 4 is an edge view of the roofing slab, seen from the ridge side.

In its raised, arched central region M the roofing slab has a vent opening 1. The opening is of rectangular contour. The longer rim edges of the opening extend in the direction of slope of the roofng slab.

The vent opening 1 is limited by an upwardly directed edge collar K. The latter extends peripherally and forms for all practical purposes, a shaft. The upper edge 2' of the two collar sections 2 which extend in transverse direction, i.e. parallel to the eaves, has a course which corresponds to that of the arched central region M of the roofing slab. With loading an air passage slot 3 on all sides, the inner surfaces 4' lying above same of a cover 4 which extends over the air passage opening 1 are also arched. The arcuate lines of the inner surfaces 4' can be so shaped in their transverse arching pattern that the upper edges 2' of the collar section 2 extend parallel to the inner surfaces 4'.

The cover 4, which also has a rectangular contour, passes into a peripheral downward-directed rim ledge 5. The rim ledge 5 and rim collar K overlap each over (see FIG. 6) so that the ventilation flow assumes a Z-shaped course 6 in the region of the air passage slot 3. The width of the gap between the rim ledge 5 and the rim collar K corresponds approximately to the width of the gap between upper edge 2' and inner surface 4' of the cover hood 4.

The ridge-side section 5' of the rim ledge 5 extends to the top-side wide surface of the roofing slab. The rim-ledge lower edge 5'' is adapted there to the course of arching of the roofing slab. The corresponding section is extended somewhat on the ridge side. The deep-drawn section 5' of the rim ledge 5 forms a skirt so that downward flowing rain water is held up and/or cannot spill over at the rim collar K. From there, accordingly, there is also no direct air entrance or emergence. The latter takes place rather from the longitudinal sides and the eaves side.

For the fastening of the hood-shaped cover 4 on the roofing slab freestanding pointed tongues 7 are used which extend from the inner side of the slab. A total of four such tongues 7 is provided. The tongues have an angular cross section. Their insertion ends lie with their outer sides against the inner corners of the rim collar K. They are bonded, interlocked or otherwise attached to the holding collar in the region of their inner corners. The insertion limiting stop is formed on the ridge side by the rim ledge section 5' which extends downwardly in skirt-like manner to the top of the roofing slab. On the eaves side this support is taken over, while leaving the air passage slot 3 open, by a spacer arm 8 respectively arranged on the back of the tongue 7.

The rim collar K is continued beyond the bottom side of the roofing slab, where it passes into a dish Sch from the bottom of which there protrudes a downwardly directed hose connecting pipe 10. The latter is of circular cross section and serves for the attachment of an air removal hose 11 (see FIG. 5).

The air removal hose 11 is developed as a flexible hose with which it is also coupled by means of the web attachment.

The extended rim collar section K' which definitely protrudes beyond the bottom side U can be formed in one piece with the roofing slab together with the dish plus hose, connection pipe 10. For accessibility or optional attachment, the embodiment shown is, however, produced in the manner that the rim collar K is developed as the mount for the dish Sch, which is developed as a separate structural part. For this purpose there is selected a plug connection in the manner that the side wall 12 of the dish Sch lies in form-fitting manner, and thus tightly overlaps, the rim collar K or, more precisely, the rim collar section K'. Outside gripping over the dish is provided. Side wall 12 and rim collar section K' are connected together by screws 13 which pass through them. The corresponding zones of attachment lie in the end regions of the corners. The passage holes for the screws 13 which are possibly developed as self-cutting screws, lie at the same distance from these corner regions so that the dish Sch can be attached swung optionally by 180 degrees. This has the advantage over the offcenter, i.e. eccentric, arrangement of the hose connecting pipe 10 on the dish Sch that a position of this pipe is obtained which is closer to the ridge or closer to the eaves. In this way one can easily get around laths or rafters which might be in the way. In the event of a square construction of the dish Sch and rim collar K, an even more far-reaching variation can be obtained with corresponding eccentric position of the hose connecting pipe 10.

Figure 6:
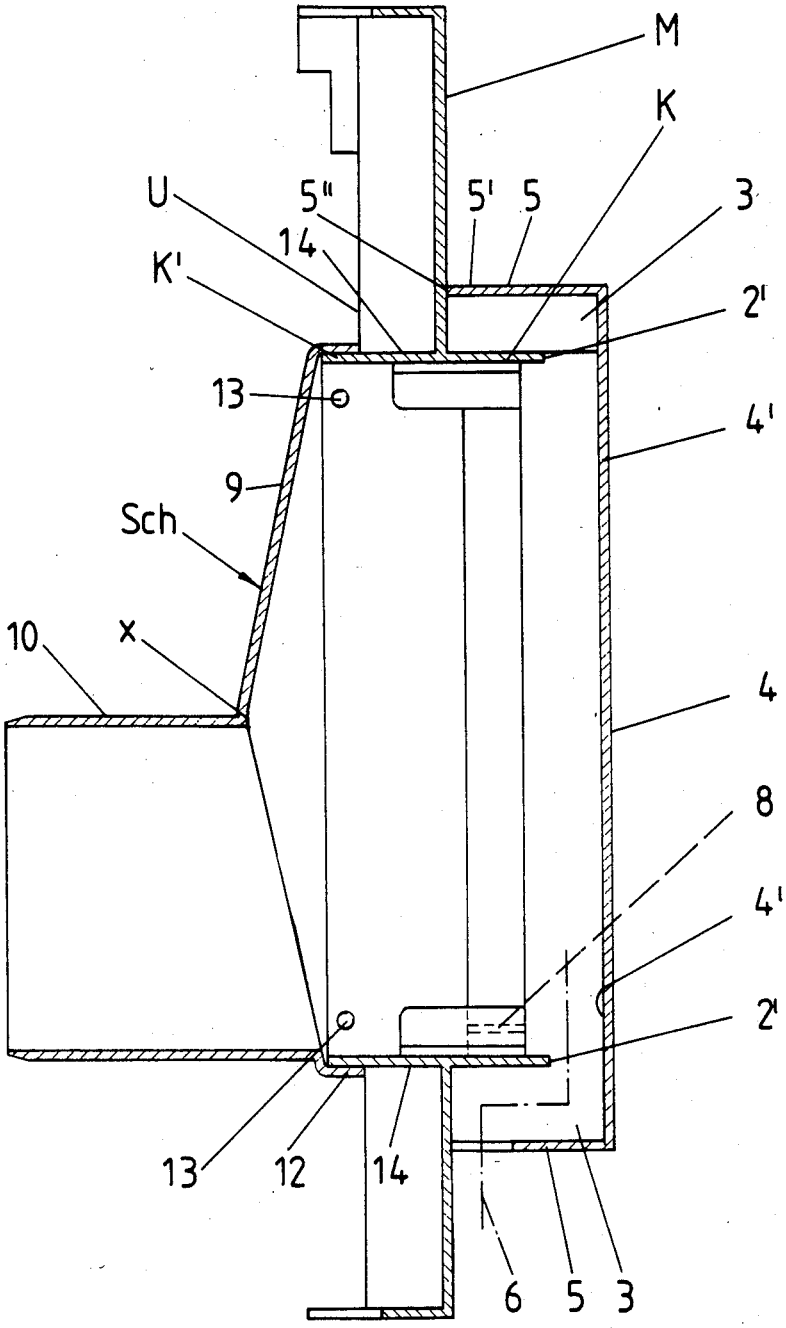
FIG. 6 is a section along the line VI—VI of FIG. 3, also on a larger scale.

In each case, the hose connecting pipe 10 is so arranged on the bottom 9 of the dish Sch that the pipe wall thereof is tangent to the center x of the bottom 9 (see FIG. 6).

The bottom 9 is pushed-in. It drops inclined on all sides towards the center x so that a sort of funnel shape is produced. Any water of condensation which collects or moisture coming from flying snow can thus run off readily. Taking into account the inclination of the roof, the hose connecting pipe 10 may lie on the eaves side in such cases.

In the case of the detachable dish Sch mounting is limited to the tightening of the screws 13.

Figure 5:
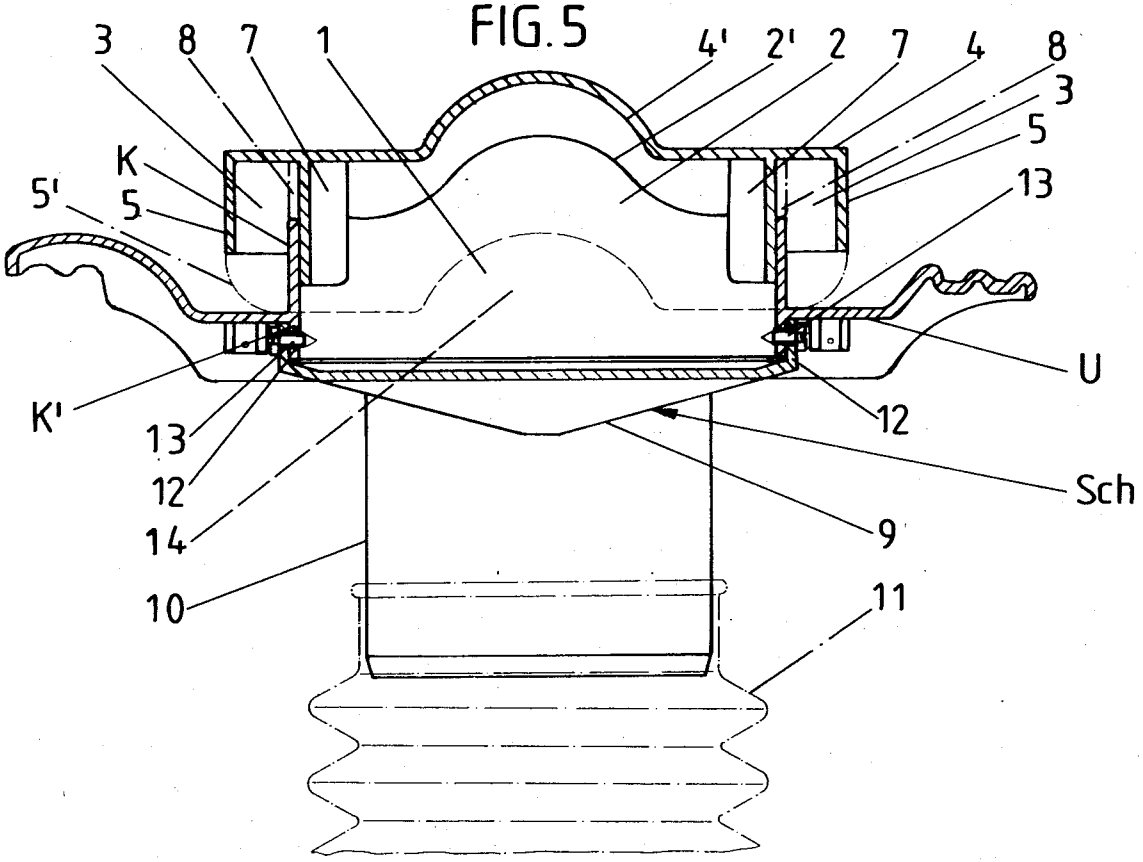
FIG. 5 is a section along the line V—V of FIG. 3, enlarged as compared with FIG. 3.

As can be noted from FIG. 5 the rim collar K is so developed that its wall crosses and closes off the inner hollow 14 resulting from the transverse arching in the central region M of the roofing slab. The top of the rim collar extends in a plane parallel to the base plane of the roofing slab.

I claim:

1. In a roofing slab with vent opening which is arranged in a central region thereof and is limited by a peripheral edge collar and over which a cover extends in hood-like manner and with which opening there is coordinated a hose connection pipe directed towards a bottom side of the roofing slab, the improvement wherein the edge collar projects beyond the bottom side of the roofing slab and extends into a dish having a bottom, and said hose connecting pipe is in sealing fluid communication with the bottom of said dish.

2. The roofing slab according to claim 1, wherein the edge collar constitutes a means for mounting the dish, the latter being a separate structural part than that of said edge collar.

3. The roofing slab according to claim 1, wherein said dish has a side wall overlapping the edge collar, and means comprising screws attachingly passing through said edge collar and said side wall.

4. The roofing slab according to claim 1, wherein the bottom of said dish extends in funnel shape towards said hose connecting pipe.

5. The roofing slab according to claim 1, wherein said hose connecting pipe is eccentrically on said bottom of said dish and is tangent to a center of said bottom of said dish.

6. The roofing slab according to claim 1, wherein said roofing slab has a transverse arching resulting in an inner hollow, and said edge collar crosses and closes off said inner hollow resulting from the transverse arching of the roofing slab.

7. The roofing slab according to claim 1, wherein said bottom of said dish has a center and said hose connecting pipe has a wall which is tangent to the center of said bottom of said dish.

* * * * *